United States Patent [19]

Stuchlik, III

[11] Patent Number: 5,069,042

[45] Date of Patent: Dec. 3, 1991

[54] CLEANABLE CONDENSATE TRAP

[76] Inventor: Charles F. Stuchlik, III, Rte. 1, Box 304 B, Milton, Del. 19968

[21] Appl. No.: 508,582

[22] Filed: Apr. 13, 1990

[51] Int. Cl.[5] ..... F25D 21/06

[52] U.S. Cl. ..... 62/284; 4/191; 62/289

[58] Field of Search ..... 62/284, 288, 289; 4/191

[56] References Cited

U.S. PATENT DOCUMENTS

| | | | |
|---|---|---|---|
| 1,156,907 | 10/1915 | King . | |
| 2,686,662 | 4/1951 | Smith . | |
| 2,962,337 | 11/1960 | Morrissey, Jr. et al. | 62/289 X |
| 3,050,957 | 8/1962 | Robbie | 62/284 X |
| 3,719,209 | 3/1973 | Rush et al. | 138/177 |
| 3,853,339 | 12/1974 | Wilson | 285/157 |
| 3,908,208 | 9/1975 | McIlroy | 4/207 |
| 4,179,762 | 12/1979 | Barnhardt et al. | 4/191 |
| 4,671,076 | 6/1987 | Duren | 62/289 |

*Primary Examiner*—Lloyd L. King
*Attorney, Agent, or Firm*—Oliff & Berridge

[57] ABSTRACT

A cleanable condensate trap usable with an air cooling system is disclosed. The condensate trap includes a U-shaped tube having first and second ends and a first T-shaped tube having first, second and third legs with the first leg being attached to the first end of the U-shaped tube. The second leg of the first T-shaped tube is connected to, for example, a drain tube which removes condensate from an air-handling portion of air cooling system. The third leg of the first T-shaped tube includes an opening whereby a cleaning device, such as brush, can be inserted into the U-shaped tube to remove material clogging the U-shaped tube. In order to detect a clogged condition of the U-shaped tube, the U-shaped tube can be made clear or transparent. Additionally, a switching device can be included in the third leg of the first T-shaped tube which can be operatively attached to a circuit which provides power to the air cooling system. When the U-shaped tube becomes clogged and liquid in the U-shaped tube rises to a predetermined level, the switch device opens the circuit and renders the air cooling system inoperative. A second T-shaped tube can be attached to the second end of the U-shaped tube to allow for the removal of clogging material from the U-shaped tube by the cleaning device.

13 Claims, 3 Drawing Sheets

CLEANABLE CONDENSATE TRAP

BACKGROUND OF THE INVENTION

1. Field of the Invention

The present invention relates to cleanable condensate traps, and in particular to a cleanable condensate trap for use with air cooling devices such as, for example, air conditioners and heat pumps.

2. Description of the Related Art

Air cooling units for buildings and houses typically include an air-handling portion, located inside the building, where cold heat exchanging tubes are contacted with warm building air to cool and dehumidify the air which is then circulated throughout the building. As the air is cooled and dehumidified in the air-handling portion, condensation is collected and conveyed away from the air-handling portion through tubing to, for example, a drain. As shown in U.S. Pat. No. 2,686,662 to Smith, the drain tube commonly includes a trap portion.

It is useful to provide a trap in the drain tube to create a fluid seal between the air in the cooling system and external air. However, these traps, which are made from, for example, ¾ inch tubing, can become clogged by mold, mildew, dirt, etc. If the clogged condition of the condensate trap is undetected, liquid collects in the air-handling portion and the air cooling unit does not adequately dehumidify the building air. More importantly, the water which collects in the air-handling portion can overflow and damage drywall, ceilings, etc. in the building. Frequently, repair and painting are required due to water stain damage caused by the overflowing liquid. Additionally, since the tubing used to make these drains is of a small diameter, it is difficult to reach the trap with a snake for unclogging the trap. Consequently, a clogged trap must be removed (i.e., by sawing the pipe on either side of the trap) and a new trap must be inserted. Replacing these traps is time consuming and also does not solve the clogging problem since the new trap is not prevented from becoming clogged.

U.S. Pat. No. 1,156,907 to King discloses a cleanable sewer trap which contains a cleaning port to allow cleaning of the trap without interfering with an inlet pipe to the trap. The trap of King is not transparent and is buried underground; therefore clogging cannot be detected until liquid overflow at the source occurs. Additionally, King does not recognize or solve any of the problems associated with air cooling systems addressed by the present invention.

U.S. Pat. No. 3,908,208 to McIlroy discloses a transparent trap for detecting a clogged condition thereof. The trap of McIlroy must be removed from the associated drainage tubing to be unclogged which can be messy and inconvenient. Additionally, McIlroy does not recognize or solve any of the problems associated with air cooling systems addressed by the present invention.

OBJECTS AND SUMMARY OF THE INVENTION

It is an object of the present invention to provide a cleanable condensate trap which can be easily cleaned when clogged by, for example, mold, mildew, dirt, etc.

It is another object of the present invention to provide a transparent condensate trap wherein a clogged condition can be viewed and thus detected prior to the occurrence of water damage due to overflowing of collected liquid.

It is another object of the present invention to provide a cleanable condensate trap having switch means for shutting off a source of liquid to prevent accumulation of liquid upstream of the trap when clogged.

A further object of the present invention is to provide an air cooling system having a cleanable trap as described above so that clogging can be easily detected and removed prior to the overflow of liquid from the air cooling system.

To achieve the foregoing and other objects, and to overcome the shortcomings discussed above, a cleanable condensate trap is provided. The present invention makes use of a U-shaped tube having first and second ends and a first T-shaped tube having first, second and third legs with the first leg being attached to the first end of the U-shaped tube. The second leg of the T-shaped tube can be attached to a source of liquid, such as an air-handling portion of an air cooling system while the third leg of the T-shaped tube includes an opening whereby a brush or other cleaning tool can be inserted into the attached U-shaped tube to remove mildew, mold, or any other clogging material from the U-shaped tube. In order to detect a clogged condition of the U-shaped tube, the U-shaped tube can be made transparent or a switch means can be included in the third leg of the T-shaped tube which will indicate a clogged condition of the U-shaped tube and/or turn off the source of liquid to prevent overflow of the liquid. Additionally, and in particular when used with an air-cooling system which uses relatively small diameter tubing, a second T-shaped tube can be attached to the second end of the U-shaped tube so that the material clogging the U-shaped tube can be pushed out of the U-shaped tube and a third leg of the second T-shaped tube and thereby removed entirely from the drain system.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

Figure 1:
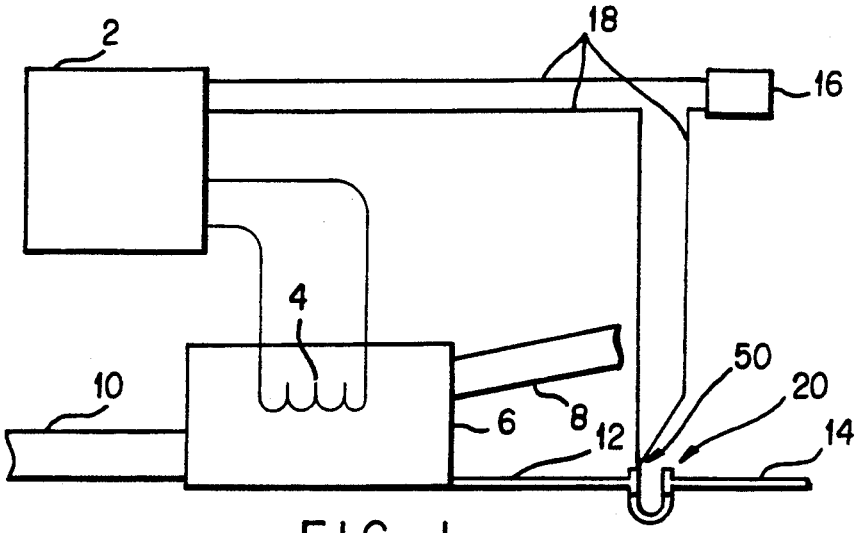
FIG. 1 is a diagrammatic view of an air cooling system incorporating the cleanable condensate trap of the present invention.

FIG. 1 illustrates an air cooling system including a cleanable condensate trap 20 according to the present invention. The cooling system includes air cooling means 2 which can be, for example, an air conditioning unit or a heat pump. The air cooling means is operatively associated with an air handler 6 which includes heat exchange coils 4 which carry a cold material for cooling warm air conveyed to the air handler 6 through duct 8. Cooled air is conveyed away from air handler 6 through duct 10. As the air is cooled, liquid in the air condenses and is removed from the air and conveyed away from air handler 6 through tube means 12, 14 to, for example, a drain. Cleanable condensate trap 20 is located between tube means 12 and 14 and provides a liquid seal between air located in air handler 6 and air located downstream of tube 14. Tubing 12,14 conventionally is relatively small ($\frac{3}{4}$ inches in diameter) since a relatively low flow rate of liquid is carried therethrough. Air cooling means 2 is controlled by, for example, a thermostat 16 which is electrically connected to air cooling means 2 via a circuit 18. One embodiment of the present invention provides switch means 50 operatively associated with trap 20. Switch means 50 opens circuit 18 when liquid in trap 20 rises to a predetermined level due to clogging of trap 20. In this manner, air cooling means 2 is rendered inoperative when trap 20 is clogged to prevent the production of any further condensation and thus prevent the overflow of liquid and the damage associated therewith.

Figure 2:
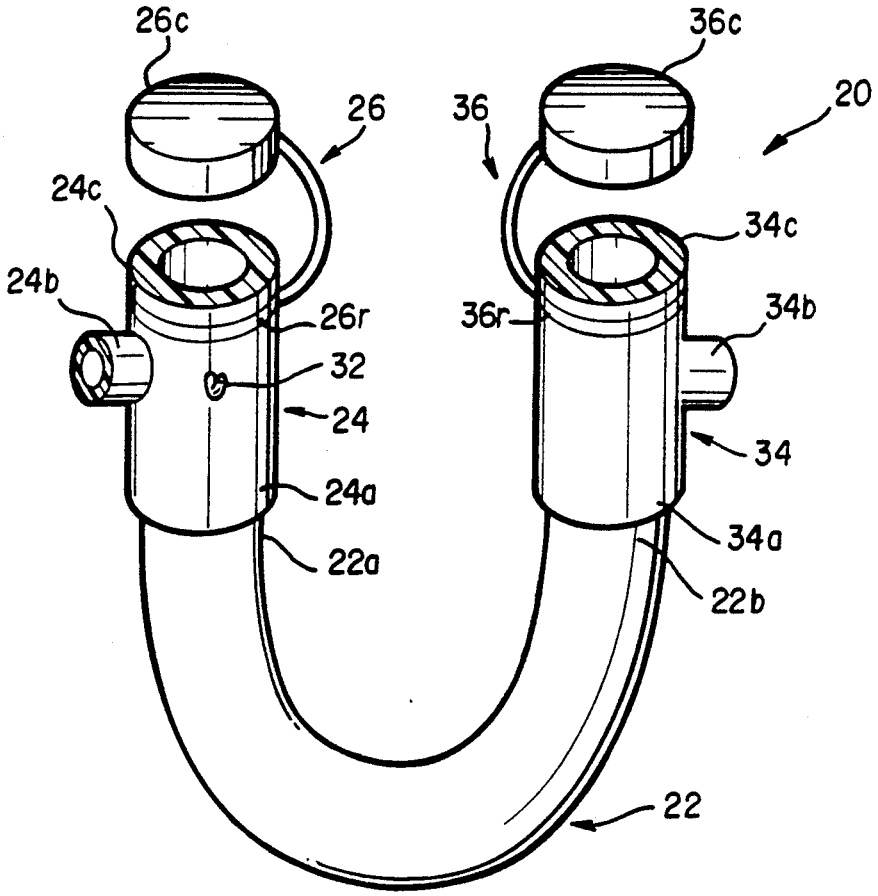
FIG. 2 is an exploded, isometric view of one embodiment of the cleanable condensate trap of the present invention.
Figure 2A:
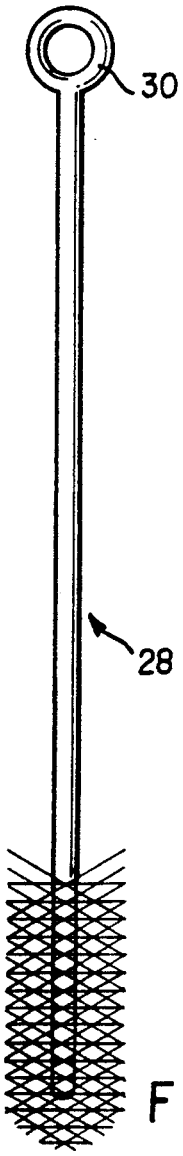
FIG. 2A is an isometric view of a cleaning tool usable with the FIG. 2 trap.

FIG. 2 shows a first embodiment of the cleanable condensate trap 20. Trap 20 includes a U-shaped tube 22 having first and second ends 22*a*, 22*b* and first and second T-shaped tubes 24, 34 having first, second and third legs, 24*a*, 34*a*; 24*b*, 34*b*; and 24*c*, 34*c*, respectively. The first leg 24*a* of the first T-shaped tube 24 is attached to the first end 22*a* of U-shaped tube 22 and the second leg 24*b* of the first T-shaped tube 24 is attached to drain tube 12. The first leg 34*a* of the second T-shaped tube 34 is attached to the second end 22*b* of the U-shaped tube 22 and the second leg 34*b* of the second T-shaped tube 34 is attached to drain tube 14. The third legs 24*c*, 34*c* of the first and second T-shaped tubes 24,34 can remain open, but are preferably removably closed by caps 26,36 or a plug 38 (see FIG. 3). Preferably caps 26,36 include a cap portion 26*c*,36*c* and a ring portion 26*r*,36*r* which is secured to the third leg so that cap portions 26*c*,36*c* can be removed from third legs 24*c*,34*c* without being lost. When the third legs 24*c*,34*c* are open, a brush 28 (see FIG. 2A) can be inserted into an opening of third leg 24*c* and pushed through the U-shaped tube 22. Brush 28 has a length sufficient to extend from leg 24*c* through U-shaped tube 22 to third leg 34*c* and thus any material clogging U-shaped tube 22 can be removed from the open end of third leg 34*c*. In this manner, the trap of the present invention can be unclogged easily, without removal of any of the drainage tubing. Brush 28 is preferably made from plastic so that it is sufficiently flexible to pass through U-shaped tube 22 without damaging U-shaped tube 22. The flexibility of brush 28 is particularly important when U-shaped tube 22 is made from a flexible material as described below. A hook 32 can be provided on either of the T-shaped tubes 24,34 to engage and hold a ring 30 on brush 28. Since the tubing and trap have a relatively small diameter and the pressure of the liquid flowing through trap 22 is relatively low, it is preferable to provide the second T-shaped tube 34 so that an opening (34*c*) is provided for removal of the material clogging trap 20. However, the second T-shaped tube 34 can be omitted if the clogging material can be sufficiently flushed through tube 14 without clogging same.

Figure 3:
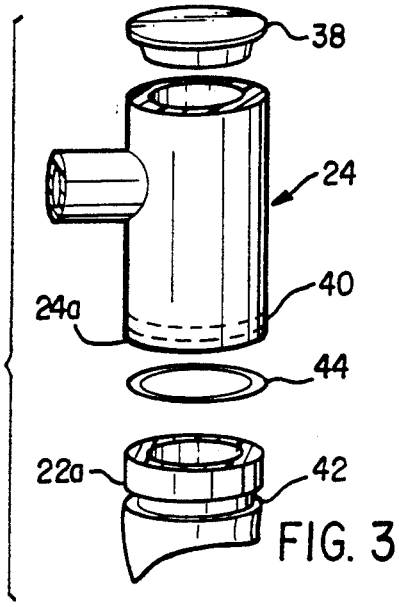
FIG. 3 is an exploded, isometric view of a second embodiment of the present invention wherein an O-ring seal is used to attach a rigid U-shaped tube to the first T-shaped tube.

In a preferred embodiment, illustrated in FIG. 2, U-shaped tube 22 is made from a clear or transparent polyvinyl chloride (PVC) material which is flexible. Each end of the U-shaped tube 22*a*, 22*b* is inserted inside of the first leg 24*a*,34*a* of its corresponding T-shaped tube, 24,34, respectively and is permanently glued in place therein. Alternatively, U-shaped tube 22 can be made from a rigid material and can be removably inserted into the first legs 24*a*,34*a* of the T-shaped tubes 24,34. FIG. 3 illustrates the connection of first end 22*a* of a rigid U-shaped tube to first leg 24*a*. In this alternative embodiment, an inside surface of first leg 24*a* includes a groove 40, an outside surface of the first end of U-shaped tube 22*a* includes a groove 42 and an O-ring 44 is disposed between the inner surface of first leg 24*a* and the outer surface of first end 22*a* so as to seat in each of grooves 40 and 42 and removably hold T-shaped tube 24 and U-shaped tube 22 together while providing a liquid seal therebetween. A similar type of connection is provided between second end 22*b* of U-shaped tube 22 and the first leg 34*a* of the second T-shaped tube 34. With this construction, the U-shaped tube can be removed and cleaned or replaced without sawing or any special tools. This is particularly convenient when the open end of third legs 24*c*, 34*c* are inaccessible.

In order to permit the detection of a clogged condition of trap 20, U-shaped tube 22 can be made clear or transparent. As discussed above, clear, flexible, PVC tubing is preferred for the U-shaped tube 22 because it is readily available and can be easily adapted to existing condensate drainage tubes due to its flexibility. Clear or transparent rigid U-shaped tubes can also be used if desired, and, although more expensive, it is understood that only a portion of the U-shaped tube 22, for example, the upstream portion, needs to be transparent. While the transparent or clear U-shaped tube 22 provides a convenient way to detect a clogged condensate trap, this design is not fool-proof since it requires a person to intermittently check the condition of trap 20. In order to further ensure that a clogged condition of condensate trap 20 will not go unnoticed and that the overflow of liquid will not occur, a switch means 50 can be provided in the first T-shaped tube 24 which is actuated by the rising liquid level in U-shaped tube 22 which occurs when a clogged condition exists.

Figure 4A:
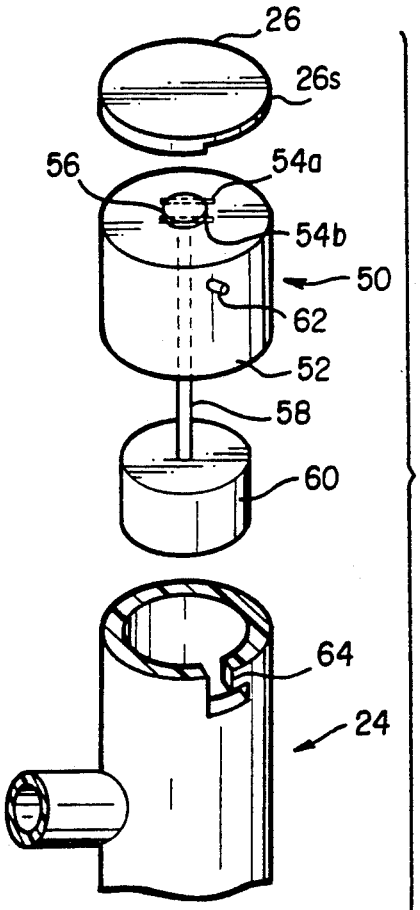
FIGS. 4*a* and 4*b* illustrate a third embodiment of the present invention wherein a switch means is included in the first T-shaped tube to shut off a source of liquid to the condensate trap.

As shown in FIG. 4*a*, switch means 50 can include a body portion 52 which is removably, slidably inserted into third leg 24*c* of the first T-shaped tube 24. Body portion 52 can include a pin 62 which fits into and engages slot 64 in an end portion of the third leg 24*c*. Body portion 52 also includes stationary contacts 54*a*, 54*b* which can be attached to a circuit. In this embodiment, cap 26 includes a slot 26*s* which permits wires to be attached to contacts 54*a*, 54*b*. A movable contact 56 closes the circuit by electrically connecting stationary contacts 54*a* and 54*b* to each other when in its lowest position. Movable contact 56 is attached to a float 60 through shaft 58. When body portion 52 is inserted inside the third leg 24*c*, float 60 is arranged such that it will rise and lift movable contact 56 out of physical contact with stationary contacts 54*a*, 54*b* when U-shaped tube 22 becomes clogged and liquid collects and rises to or above a predetermined level in U-shaped tube 22. Cap 26 is constructed so that space will be provided over body portion 52 to permit upward movement of movable contact 56. By wiring contacts 54*a*, 54*b* into circuit 18, which controls the operation of air cooling means 2, air cooling means 2 can be rendered inoperable by opening the circuit 18 with movable contact 56 when liquid in U-shaped tube 22 rises to or above a predetermined level, thus indicating a clogged condition of U-shaped tube 22 and preventing the production of any additional condensation in air handler 6.

Figure 4B:
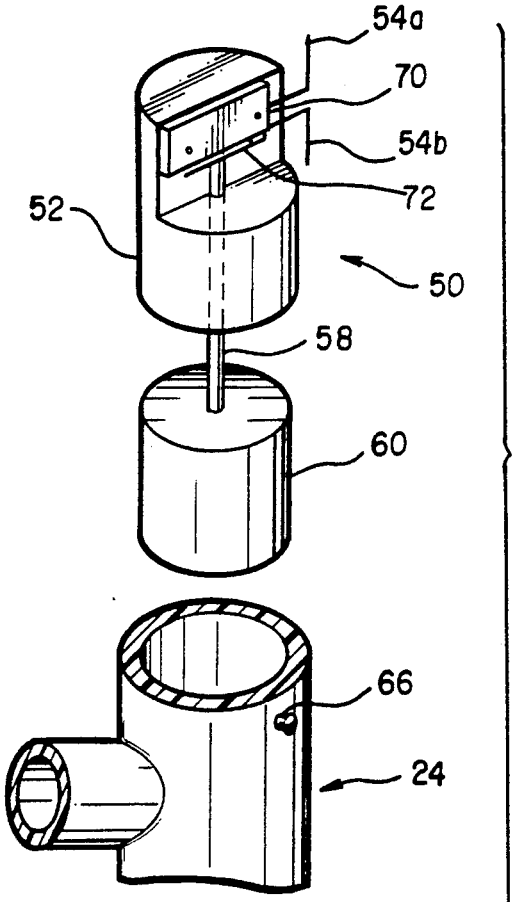

FIG. 4*b* shows a modification of the switch of FIG. 4*a* wherein a microswitch 70 is used to open and close the control circuit. In FIG. 4*b*, switching lever 72 of microswitch 70 is operatively associated with shaft 58 of float 60 so that switching lever 72 will be actuated to open the microswitch 70 when liquid in U-shaped tube 22 rises to or above a predetermined level. FIG. 4*b* also shows an alternative structure for removably mounting switch means 50 in the third leg 24*c* of the first T-shaped tube 24. In this embodiment, a set screw 66 extends through the third leg 24*c* to contact a surface of body portion 52 and can be tightened, for example, by a screwdriver to maintain switch means 50 in position in third leg 24*c*. In this manner, switch means 50 can be removed from T-shaped tube 24*c* so that U-shaped tube 22 can be cleaned.

Figure 5:
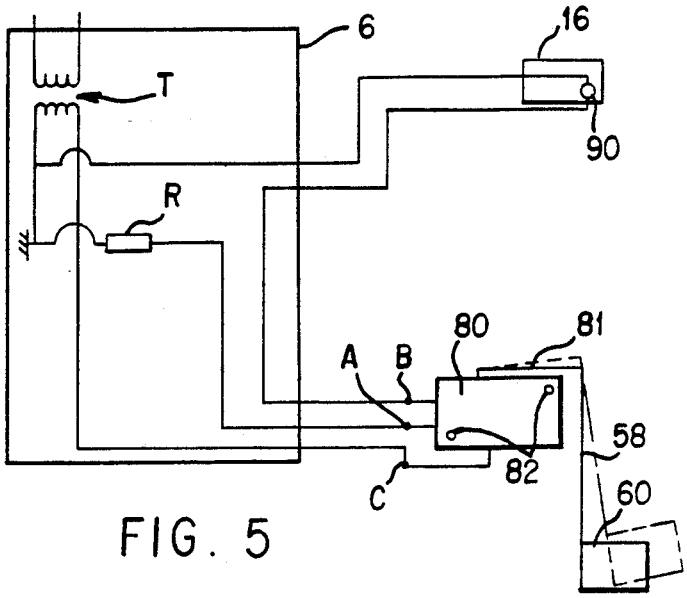
FIG. 5 is a schematic diagram of an embodiment of the present invention wherein a float-controlled switch means functions to render an air cooling system inoperative and to actuate an alarm when condensate trap becomes clogged and fills with liquid.

FIG. 5 shows an embodiment of the present invention which utilizes a microswitch 80 for rendering an air-cooling system inoperative and for actuating an alarm when liquid collects in U-shaped tube 22 due to a clogged condition thereof. Microswitch 80 includes a switching lever 81 attached to shaft 58 which includes a float 60. When assembled with U-shaped tube 22, float 60 is located in first T-shaped tube 24 so that it is in a lower position (shown by solid lines in FIG. 5) when U-shaped tube is open to fluid flow, but rises to an upper position (shown by broken lines in FIG. 5) when liquid in U-shaped tube rises due to a clogged condition of U-shaped tube 22. Microswitch 80 includes three contacts A, B and C, with contact C being a common hot feed supplied with, for example, twenty-four volts via transformer T. When switch lever 81 is in the lower position, common hot feed C is electrically connected to contact A so that control relay R is activated and permits air cooling means 2 to operate as usual. When switch 81 is in the lower position, common hot feed C is not electrically connected to contact B. When a clogged condition in U-shaped tube 22 occurs and liquid rises to or above a predetermined level in U-shaped tube 22, float 60 will rise and move switch lever 81 to its upper position. When switch lever 81 is in its upper position, the electrical connection between common hot feed C and contact A opens, deactivating control relay R and rendering air-cooling means 2 inoperative. At the same time, common hot feed C is electrically connected to contact B to close a circuit which includes an alarm light 90 located on the thermostat 16 to indicate the clogged condition of U-shaped tube 22. While alarm light 90 is illustrated as part of thermostat 16, it is understood that alarm light 90 can be made separate from thermostat 16 and positioned at any location which is convenient. It is also understood that microswitch 80 can be connected to circuits so that it only actuates alarm 90, only actuates relay R, or actuates both alarm 90 and relay R.

Figure 6:
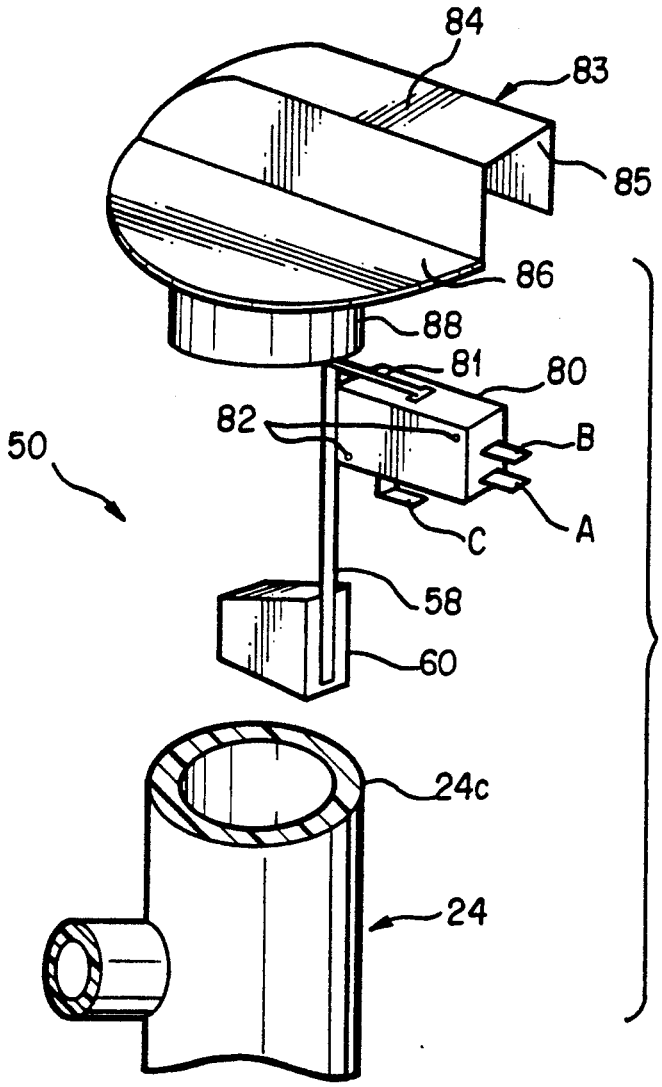
FIG. 6 is an exploded view of the switch means of FIG. 5 and the structure for mounting the switch means to the third leg of a T-shaped tube.

FIG. 6 shows a microswitch holder/cover 83 for removably mounting microswitch 80 in third leg 24*c* of first T-shaped tube 24. Microswitch holder/cover 83 can be made from plastic and includes a holding portion 84 which removably attaches to microswitch 80 by, for example, the insertion of tabs 85 into holes 82 formed in the microswitch 80. Alternatively, microswitch 80 can be mounted in holding portion 84 by inserting screws through side surfaces of holding portion 84 and into holes 82 in microswitch 80. Microswitch holder/cover 83 also includes cover portion 86 which extends outwardly from holder portion 84 a distance sufficient to entirely close the opening provided in third leg 24*c* of first T-shaped tube 24. An annular mounting portion 88 extends downwardly from cover portion 86 and is inserted into the opening in the third leg 24*c* of first T-shaped tube 24. Mounting portion 88 is constructed with dimensions sufficient to securely mount microswitch holder/cover 83 and microswitch 80 in the first T-shaped tube 24 by frictionally engaging an inner surface of the opening in third leg 24*c*. Microswitch holder/cover 83 can be molded from plastic materials or constructed from materials such as, for example, aluminum.

Although a specific example is disclosed, the present invention is applicable to any type of liquid conveying system which employs a trap. While T-shaped tubes 24,34 have been described, tubes having other shapes can also be used as long as these tubes function to attach tube means 12 to a U-shaped tube 22 and provide a third port for accessing U-shaped tube 22 with a cleaning tool or switch means 50. Additionally, a one-piece tube can be used which attaches to tube means 12 and includes a U-shaped portion as well as an access port for cleaning the U-shaped portion or for insertion of switch means 50. Accordingly, the preferred embodiments of the invention as set forth herein are intended to be illustrative, not limiting. Various changes may be made without departing from the spirit and scope of the invention as defined by the following claims.

What is claimed is:

1. An air-cooling system comprising:

means for cooling air;

air handling means for containing air which is contacted with said means for cooling air and for receiving liquid removed from the air as a result of condensation;

tube means fluidwise connected to said air handling means, for conveying liquid away from said air handling means, wherein said tube means includes a trap having a U-shaped tube having first and second ends and a first T-shaped tube having first, second and third legs, said first leg being attached to said first end of said U-shaped tube and said second leg being attached to said tube means, whereby said trap can be cleaned by inserting a cleaning tool into said third leg of said first T-shaped tube and through said U-shaped tube;

a first circuit electrically connected to said means for cooling air for controlling the supply of power to said means for cooling air; and switch means, inserted into said third leg of said first T-shaped tube, electrically connected to said first circuit and for closing said first circuit when liquid in said U-shaped tube is below a predetermined level to render said air cooling means operative and for opening said first circuit when liquid in said U-shaped tube is equal to said predetermined level to render said air cooling means inoperative.

2. The system according to claim 1, wherein said U-shaped tube is transparent.

3. The system according to claim 1, wherein said switch means also opens a second circuit when liquid is below the predetermined level and closes the second circuit when liquid is equal to the predetermined level, said second circuit being electrically connected to an alarm means whereby said alarm means is activated when liquid reaches the predetermined level.

4. The system according to claim 1, wherein said switch means include at least two contacts attached to said first circuit, and connecting means for electrically connecting said at least two contacts when liquid in said U-shaped tube is below a predetermined level and for separating said at least two contacts when liquid in said U-shaped tube is equal to said predetermined level.

5. The system according to claim 4, wherein said at least two contacts include first and second stationary contacts attachable to wires and said connecting means includes a movable contact which moves between an open position wherein said movable contact does not electrically connect said first and second stationary contacts and a closed position wherein said movable contact electrically connects said first and second stationary contacts, and a float attached to said movable contact whereby said contact is in the closed position when liquid in said U-shaped tube is below the predetermined level and is in the open position when liquid in said U-shaped tube is equal to the predetermined level.

6. The system according to claim 4, wherein said connecting means includes a microswitch having said at least two contacts and being operatively associated with a float, whereby said microswitch is in a closed position when liquid in said U-shaped tube is below the predetermined level and is in an open position when liquid in said U-shaped tube is equal to the predetermined level.

7. The system according to claim 1, wherein said air-cooling means is an air-conditioner.

8. The system according to claim 1, wherein said air-cooling means is a heat-pump.

9. The system according to claim 1, further comprising a second T-shaped tube having first, second and third legs, said first leg of said second T-shaped tube being attached to said second end of said U-shaped tube.

10. The system according to claim 9, further comprising further tube means connected to said second leg of said second T-shaped tube, for conveying liquid away from said U-shaped tube.

11. The system according to claim 9, further comprising first and second closure means for removably closing an opening of said third legs of said first and second T-shaped tubes respectively.

12. An air-cooling system comprising:

means for cooling air;

air handling means for containing air which is contacted with said means for cooling air and for receiving liquid removed from the air as a result of condensation; and tube means, fluid connected to said air handling means, for conveying liquid away from said air handling means, said tube means including a cleanable trap, said cleanable trap comprising:

a transparent U-shaped tube having first and second ends;

a first T-shaped tube having first, second and third legs, said first leg being attached to said first end of said U-shaped tube, said second leg being attached to said tube means;

a second T-shaped tube having first, second and third legs, said first leg of said second T-shaped tube being attached to said second end of said U-shaped tube, said second leg of said second T-shaped tube being attached to a further tube means for conveying liquid away from said cleanable trap;

first closure means for removably closing an opening in said third leg of said first T-shaped tube; and a cleaning tool for cleaning said cleanable trap by insertion into said third leg of said first T-shaped tube and through said U-shaped tube, said cleaning tool being stored externally of said cleanable trap when not being used to clean said cleanable trap.

13. The air-cooling system of claim 12, wherein said cleanable trap includes a fastener on an external surface thereof for releasably holding said cleaning tool when said cleaning tool is being stored externally of said cleanable trap.

* * * * *